US005358281A

United States Patent [19]

Greig

[11] Patent Number: 5,358,281

[45] Date of Patent: Oct. 25, 1994

[54] SECURITY PRESSURE SENSITIVE LABEL

[75] Inventor: Walter G. Greig, Lewiston, N.Y.

[73] Assignee: Moore Business Forms, Inc., Grand Island, N.Y.

[21] Appl. No.: 15,824

[22] Filed: Feb. 10, 1993

[51] Int. Cl.[5] ..... B42D 15/00

[52] U.S. Cl. ..... 283/81; 283/94; 283/101; 283/108; 428/42; 428/43; 428/916

[58] Field of Search ..... 283/81, 94, 100, 101, 283/108; 428/40, 41, 42, 43, 916

[56] References Cited

U.S. PATENT DOCUMENTS

| | | | |
|---|---|---|---|
| 2,250,197 | 7/1941 | Humphner . | |
| 3,923,198 | 12/1975 | Brochman | 283/81 X |
| 4,008,115 | 2/1977 | Fairbanks et al. | 156/267 |
| 4,166,144 | 8/1979 | Amberkar | 428/40 |
| 4,184,701 | 1/1980 | Franklin et al. | 283/81 X |
| 4,543,139 | 9/1985 | Freedman . | |
| 4,608,288 | 8/1986 | Spindler | 283/81 X |
| 4,721,638 | 1/1988 | Matsuguchi et al. | 283/81 X |
| 4,742,954 | 5/1988 | Shishido | 283/94 X |
| 4,746,556 | 5/1988 | Matsuguchi et al. . | |
| 4,772,650 | 9/1988 | Ou-Yang . | |
| 4,825,801 | 5/1989 | Weber . | |
| 4,826,213 | 5/1989 | Matsuguchi et al. . | |
| 4,837,061 | 6/1989 | Smits et al. . | |
| 4,876,123 | 10/1989 | Rivera et al. | 428/916 X |
| 5,011,190 | 4/1991 | Matsuguchi et al. | 283/101 |
| 5,020,831 | 6/1991 | Benardelli . | |
| 5,042,842 | 8/1991 | Green et al. . | |
| 5,153,042 | 10/1992 | Indrelie . | |

FOREIGN PATENT DOCUMENTS

| | | | |
|---|---|---|---|
| 7398 | 1/1991 | Japan | 283/100 |

*Primary Examiner*—Mark Rosenbaum
*Assistant Examiner*—Frances Han
*Attorney, Agent, or Firm*—Nixon & Vanderhye

[57] ABSTRACT

A security label is constructed from label stock having top and bottom faces. A release coat is provided on the label stock bottom face, a non-opaque tie coat provided on the release coat, and an opaque coat of permanent pressure sensitive adhesive provided on the tie coat. The tie coat has a significantly greater affinity for the adhesive than for the release coat. Indicia, such as reverse printed alphanumeric characters, is provided on the tie coat substantially between the adhesive and the tie coat so that "void", or a similar security designation, is indicated if the label stock is removed. A release liner may cover the permanent pressure sensitive adhesive, or paper stock having a second tie coat with repositional adhesive over the tie coat may be provided engaging the permanent pressure sensitive adhesive.

21 Claims, 2 Drawing Sheets

FIG. 3
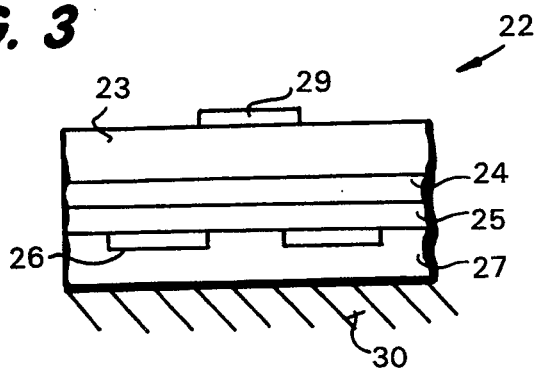
FIG. 4
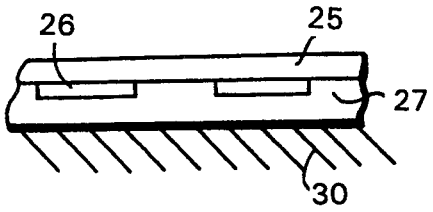
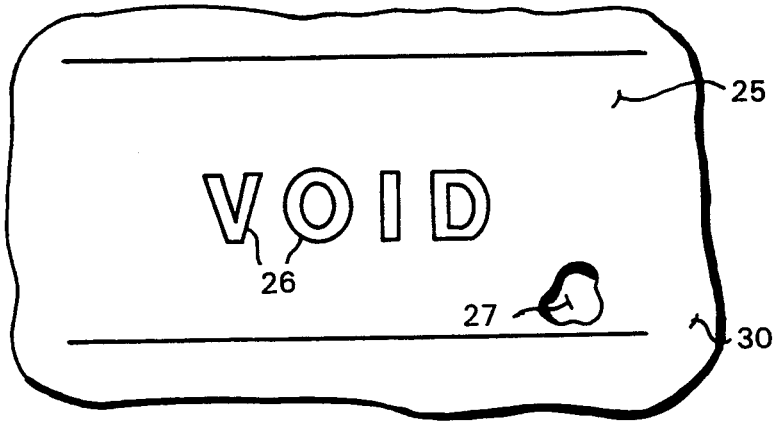
FIG. 5
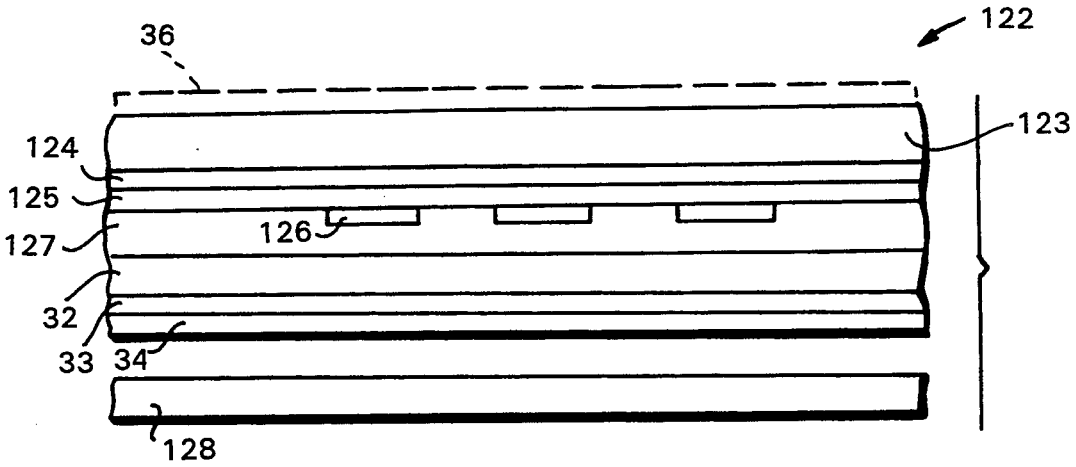
FIG. 6

SECURITY PRESSURE SENSITIVE LABEL

BACKGROUND AND SUMMARY OF THE INVENTION

There are many situations in which it is highly desirable to be able to determine if a label has been tampered with. For example, if the label is to provide a price or other indicator of characteristics of an object and is applied to the object, it is highly desirable to know if the label is removed from the object. Similar concerns apply to documents, containers which are desirably sealed before use, and in a wide variety of other environments; that is, in such environments, the fact that a label has been tampered with is extremely useful information.

According to the present invention a label, and a method of production thereof, are provided which indicate clearly if the label has been tampered with, and also prevent the re-application (except in a tamper evident mode) of the label once it has been removed.

According to a first aspect of the present invention a security label is provided having the following elements: Label stock having a top face and a bottom face. A release coat provided on the label stock bottom face. A non-opaque tie coat provided on the release coat. A coat of pressure sensitive adhesive provided on the tie coat, the tie coat having substantially greater affinity for the adhesive than the release coat. And indicia provided on the tie coat substantially between the adhesive and the tie coat. The pressure sensitive adhesive preferably is opaque permanent adhesive, and the indicia comprises reverse printed alphanumeric characters such as those indicating a problem situation (e.g., the word "void" or "fraud" or "danger", etc.). The label may be a linerless label, having a release coat on the top face of the label stock, as well as informational indicia, and a release liner may be provided covering the pressure sensitive adhesive. Alternatively, instead of the release liner contacting the permanent pressure sensitive adhesive, there can be further sheet stock (e.g., paper stock) engaging the permanent adhesive at a first face thereof, a second tie coat on a second face of the sheet stock, and repositional adhesive on the tie coat. The repositional adhesive has a greater affinity for surfaces to which it is designed to be applied than the non-opaque tie coat has for the release coat on the back of the label stock. In this construction, the repositional adhesive would also allow the label to be clearly removed from most surfaces but would provide a security feature if the label stock was removed, exposing the security words or design.

According to another aspect of the present invention a security label is provided comprising the following elements: Label stock having a top face and a bottom face. A release coat provided on the label stock bottom face. A non-opaque first tie coat provided on the release coat. A coat of permanent pressure sensitive adhesive provided on the first tie coat, the first tie coat having substantially greater affinity for the adhesive than for the release coat. Indicia associated with the first tie coat. Sheet stock having first and second faces, the first face engaging the permanent adhesive. A second tie coat on the sheet stock second face. And repositional adhesive on the second tie coat.

The invention also contemplates a method of making a label from label stock having top and bottom faces. The method comprises the following steps: (a) Applying a release coat to the label stock bottom face. (b) Applying a non-opaque tie coat to the release coat. (c) Reverse printing security indicia on the tie coat. And (d) coating the reverse printing and tie coat with pressure sensitive adhesive. Step (d) may be practiced utilizing a permanent adhesive, and there may be the further step of covering the adhesive with a release liner. Alternatively, there may be the further steps of: (e) applying the first face of the sheet stock to the permanent adhesive, (f) applying a second tie coat to the second face of the sheet stock, and (g) applying a repositional adhesive to the second tie coat.

The label stock according to the present invention clearly indicates tampering since when the label stock is removed the tie coat comes with it but none of the other components, so that the indicia on the now exposed tie coat is visible. The label stock no longer has adhesive on the back because the tie coat transferred to the surface of the pressure sensitive adhesive when the label was removed from the surface to which it was applied. The security feature is now visible and the pressure sensitive adhesive is covered by the tie coat which causes the adhesive to lose its adhesive characteristics; therefore, the label cannot be reapplied to another surface.

It is the primary object of the present invention to provide a simple yet effective security label and method of manufacture thereof. This and other objects of the invention will become clear from an inspection of the detailed description of the invention and from the appended claims.

BRIEF DESCRIPTION OF THE DRAWINGS

FIG. 3 view like that of FIG. 2 only showing the security label with the release liner removed and applied to a surface;

FIG. 4 is a view like that of FIG. 3 only showing the label stock having been removed so that the problem situation indicating indicia are visible;

FIG. 5 is a top plan view of the surface of FIGS. 3 and 4 showing the label in the condition of FIG. 4 wherein the security indicia are visible; and FIG. 6 is a view like that of FIG. 2 only showing another exemplary embodiment of label according to the present invention.

DETAILED DESCRIPTION OF THE DRAWINGS

Figure 1:
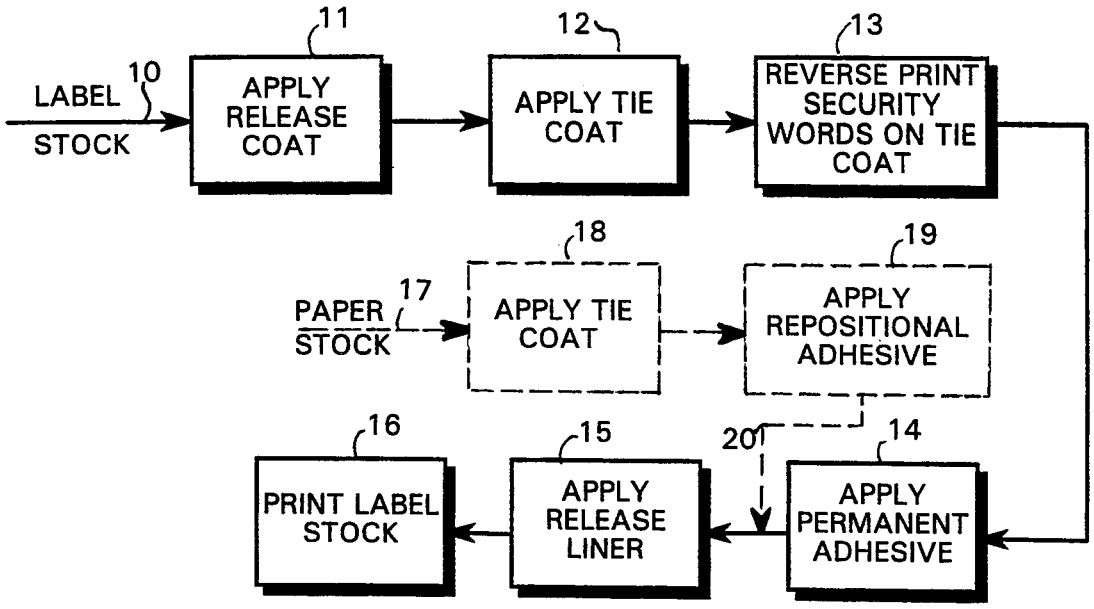
FIG. 1 is a diagrammatic view showing exemplary method steps that may be practiced according to the method of the present invention.

FIG. 1 schematically illustrates an exemplary manner of producing a security label according to the present invention. Label stock 10, such as paper, passes to a step/stage 11 where a release coat is supplied to its bottom face. The top face of the label stock 10 may have been preprinted or may be subsequently printed as hereinafter described. To the release coat is applied a first non-opaque (e.g., transparent or translucent) tie coat, and then, after drying of the tie coat, indicia is imaged on the tie coat. As indicated at step 13 wherein security words (alpha numeric characters) are regular or reverse printed on the tie coat with ink, such as with a non-contact (e.g., ink jet) printer, a contact (plate) printer, or the like. Then after drying of the indicia, a pressure sensitive permanent adhesive, preferably an opaque adhesive, is applied at stage 14. If the top face of the label stock 10 is release coated, then the continuous label construction formed by the practice of steps 11 through 14 may be wound up in a roll to produce a linerless continuous label roll.

If the linerless label construction is not desired or practical for a particular situation and materials, the release liner is applied to the permanent adhesive as indicated at stage 15. If the label stock has not previously been printed, then it may be printed as indicated at stage 16.

As an alternative to the procedure described above, paper, or like sheet stock, 17 may also be utilized to which a second tie coat is applied as indicated at stage 18, with a repositional adhesive over the second tie coat as indicated at 19. This second construction is then applied—as indicated at 20—so that the permanent adhesive applied at stage 14 is connected to the paper stock. If the release liner is applied at 15, it is applied to the repositional adhesive applied at stage 19.

All of the steps practiced as illustrated in FIG. 1 are preferably practiced continuously with the label stock in web form. Ultimately, the web can be either rolled up, made in a continuous pad construction, or may be cut into sheets with one or more labels per sheet.

Figure 2:
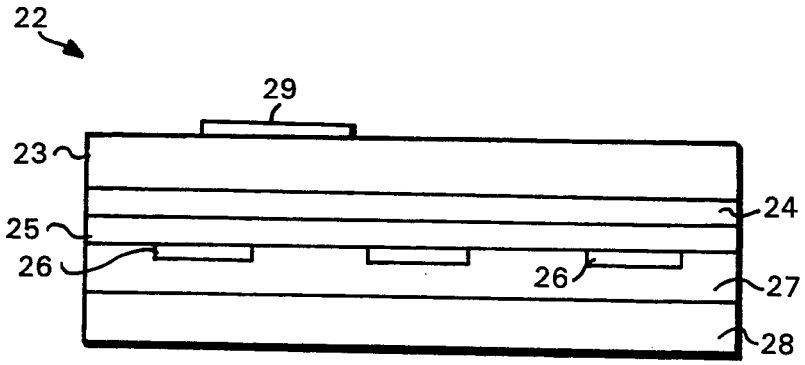
FIG. 2 is a side schematic view, with the components greatly exaggerated in size for clarity of illustration, of an exemplary security label according to the invention.

At reference numeral 22 in FIG. 2, an exemplary structure according to the present invention is illustrated. The basic label stock 23 has a release coat 24 on the bottom face thereof. The release coat material may be a silicone, UV cured release material, QUILON, or SILWET, or like conventional release material. Applied to the release material 24 is a tie coat 25. The tie coat 25 may be of a wide variety of conventional tie coats, such as Cab-O-Sperse II, available from Cabot Corp., Cab-O-Sil Division, of Tuscalo, Ill. The tie coat 25 is non-opaque, preferably transparent.

FIG. 2 further illustrates security indicia 26 which has been provided on the tie coat 25. The indicia 26 may be applied by ink jet or plate printing or the like, and preferably comprises alphanumeric characters (see FIG. 5) which are reverse printed so that in use (again see FIG. 5) they are visible in readable format. Suitable flexographic or lithographic inks available from a wide variety of suppliers can be used to print the security feature using contact printing methods. Ink jet inks can be purchased from Kodak, Trident, Brand M, and American Technologies. Suitable drying equipment that can be utilized depends on the methods of coating and printing, and the materials used (e.g. inks). Hot air dryers from TEC Systems, UV dryers from Fusion Systems, RF dryers from Radio Frequency Co., or IR dryers from Glenco Drying Systems, Kodak, Trident, Brand M, and American Technologies, are all suitable depending upon the methods and chemicals utilized.

Applied to the tie coat 25, with the indicia 26 also contacted thereby, is the pressure sensitive adhesive 27. Preferably, the pressure sensitive adhesive 27 is opaque permanent adhesive, a wide variety of such adhesives being commercially available. In the embodiment illustrated in FIG. 2, a conventional release liner 28 covers the pressure sensitive permanent adhesive layer 27.

FIG. 3 illustrates the label 22 in use on a surface 30, such as an object that is being sold for a price, the top face of the label stock 23 having informational indicia 29 thereon, such as indicating what the price is. One merely takes the label 22 of FIG. 2, and removes the release liner 28, the other layers 23 through 27 having a higher affinity for each other than the release liner 28 has for the adhesive 27. The adhesive 27 is then applied to the surface 30, with pressure, being adhesively secured to the surface 30.

If the label 22 is tampered with, when one grasps the label stock 23 and attempts to pull it away from the surface 30, because there is a higher affinity of the adhesive 27 for the tie coat 25 and the surface 30 than there is between the release coat 24 and the tie coat 25, the label stock 23 and release coat 24 will be removed, not the tie coat 25 and adhesive 27. This means that then the indicia 26 will be readable by a viewer through the non-opaque tie coat 25, as illustrated in FIGS. 4 and 5. The indicia 26 provides an indication that there is a problem, such as by utilizing the words "void", "danger", "fraud", etc.

FIG. 6 illustrates an alternative construction to that illustrated in FIGS. 2 through 5. In the FIG. 6 embodiment components comparable to those in the FIGS. 2 through 5 embodiment are shown by the same reference numeral only preceded by a "1". The embodiment of FIG. 6 is constructed utilizing the additional steps 18 through 20 schematically illustrated in FIG. 1.

The label 122 construction includes label stock 123, release coat 124, first tie coat 125, warning indicia 126, and permanent pressure sensitive adhesive 127. Connected to the adhesive 127 is a first face of sheet stock 32 (such as a sheet of paper), while the second face of the sheet stock 32 has a second tie coat 33 applied thereto. Repositional adhesive, such as CLEANTAC adhesive from Moore Business Forms, Inc. of Lake Forest, Ill., is applied to the second tie coat 33. A release liner 128 may be utilized to cover the repositional adhesive 34, or the label 122 may be made in a linerless form, as by providing a release coat 36 on the top face of the label stock 123 so that it may be wound up in a roll. The label 122 is utilized in the same manner as the label 22, the repositional adhesive 34 having a greater affinity for a surface (e.g., the surface 30) to which it is to be applied than the tie coat 125 has for the release coat 124. The repositional adhesive 34 (e.g. CLEANTAC) also allows the complete security label construction to be cleanly removed from the surface to which it was attached.

It will thus be seen that according to the present invention security label stock, and a method of manufacture thereof, have been provided which clearly illustrate tampering, and prevent reapplication of a label once removed in other than a tamper-evident manner. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of making a label from label stock having top and bottom faces, comprising the steps of:

(a) applying a release coat to the label stock bottom face;

(b) applying a non-opaque first tie coat to the release coat;

(c) printing security indicia on the first tie coat; and (d) coating the printed security indicia and first tie coat with pressure sensitive adhesive.

2. A method as recited in claim 1 wherein step (c) is practiced by reverse printing alphanumeric indicia.

3. A method as recited in claim 2 wherein step (d) is practiced utilizing a permanent adhesive, and comprising the further step of covering the adhesive with a release liner.

4. A method as recited in claim 2 wherein step (d) is practiced utilizing a permanent adhesive, and further utilizing sheet stock having first and second faces; and comprising the further steps of: (e) applying the first face of the sheet stock to the permanent adhesive, (f) applying a second tie coat to the second face of the sheet stock, and (g) applying a repositional adhesive to the second tie coat.

5. A security label comprising:

label stock having a top face and a bottom face;

a first release coat provided on said label stock bottom face;

a non-opaque first tie coat provided on said release coat;

a coat of pressure sensitive adhesive provided on said first tie coat opposite said first release coat, said first tie coat having substantially greater affinity for said adhesive than said first tie coat has for said release coat; and indicia provided on said tie coat substantially between said adhesive and said tie coat.

6. A label as recited in claim 5 wherein said pressure sensitive adhesive is opaque, and said adhesive has a greater affinity for a surface to which it is to be applied than said first tie coat has for said first release coat.

7. A label as recited in claim 5 wherein said indicia comprises reverse printed alphanumeric characters.

8. A label as recited in claim 7 wherein said indicia comprises alphanumeric characters indicating a problem situation.

9. A label as recited in claim 8 wherein said indicia comprises the word VOID.

10. A label as recited in claim 5 further comprising a release liner releasably covering said pressure sensitive adhesive, said adhesive having a greater affinity for said first tie coat than for said first release liner.

11. A label as recited in claim 5 further comprising informational indicia imaged on said top face of said label stock.

12. A label as recited in claim 5 wherein said pressure sensitive adhesive comprises permanent adhesive, said adhesive having a greater affinity for a surface to which it is to be applied than said first tie coat has for said first release coat.

13. A label as recited in claim 12 further comprising sheet, stock having first and second face; said permanent adhesive engaging said sheet stock at said first face thereof; a second tie coat on said second face of said sheet stock; and repositional adhesive on said second tie coat, said repositional adhesive having a greater affinity for a surface to which it is to be applied than said non-opaque first tie coat has for said first release coat.

14. A label as recited in claim 13 further comprising a release liner releasably covering said repositional adhesive, said repositional adhesive having a greater affinity for said second tie coat than for said release liner.

15. A label as recited in claim 5 further comprising informational indicia imaged on said top face of said label stock, and a second release coat provided on said label stock top face.

16. A security label comprising:

label stock having a top face and a bottom face;

a first release coat provided on said label stock bottom face;

a non-opaque first tie coat provided on said release coat;

a coat of permanent pressure sensitive adhesive provided on said first tie coat opposite said first release coat, said first tie coat having substantially greater affinity for said adhesive than said first tie coat has for said first release coat;

indicia associated with said first tie coat;

sheet stock having first and second faces, said first face engaging said permanent adhesive;

a second tie coat, on said sheet stock second face; and repositional adhesive on said second tie coat.

17. A label as recited in claim 16 wherein said permanent pressure sensitive adhesive is opaque.

18. A label as recited in claim 17 wherein said indicia comprises reverse printed alphanumeric security characters.

19. A label as recited in claim 18 further comprising a release liner releasably covering said repositional adhesive, said repositional adhesive having a greater affinity for said second tie coat than said repositional adhesive has for said release liner; and further comprising informational indicia imaged on said top face of said label stock.

20. A label as recited in claim 19 wherein said repositional adhesive has a greater affinity for a surface to which it is to be applied than said first tie coat has for said first release coat.

21. A label as recited in claim 16 wherein said indicia comprises security indicia imaged on said first tie coat between said first tie coat and said permanent adhesive.

* * * * *